US006241351B1

(12) United States Patent
Stephenson

(10) Patent No.: US 6,241,351 B1
(45) Date of Patent: Jun. 5, 2001

(54) PORTABLE RECHARGEABLE BATTERY POWERED PRINTER FOR USE WITH A COMPUTER

(75) Inventor: Stanley W. Stephenson, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/010,020

(22) Filed: Jan. 21, 1998

(51) Int. Cl.[7] ..... B41J 3/36
(52) U.S. Cl. ..... 347/109
(58) Field of Search ..... 347/109, 19; 400/88; 395/200.78; 307/104

(56) References Cited

U.S. PATENT DOCUMENTS 5,455,466 * 10/1995 Parks et al. ..... 307/104
5,666,497 * 9/1997 Milhaupt et al. ..... 395/309
5,685,651 * 11/1997 Hayman et al. ..... 347/109
5,835,107 * 11/1998 Suzuki et al. ..... 347/19
5,974,238 * 10/1999 Chase, Jr. ..... 395/200.78

* cited by examiner

*Primary Examiner*—John Barlow
*Assistant Examiner*—Charles W. Stewart, Jr.
(74) *Attorney, Agent, or Firm*—Raymond L. Owens

(57) ABSTRACT

A portable battery powered printer for printing images from an image source is disclosed. The image source can be a computer for storing a digital image and defining an opening. The printer is sized so as to be insertable into the image source opening and having a rechargeable battery. When the printer is connected to the image source it can be recharged and receives image data from the image source. The printer includes a device for printing an image from the received image data.

3 Claims, 4 Drawing Sheets

PORTABLE RECHARGEABLE BATTERY POWERED PRINTER FOR USE WITH A COMPUTER

CROSS REFERENCE TO RELATED APPLICATION

The present invention is related to commonly assigned U.S. patent application Ser. No. 08/824,694 filed Apr. 8, 1997, entitled "Printing Variable Density Pixels" to Stanley W. Stephenson. The disclosure of this related application is incorporated herein by reference.

FIELD OF THE INVENTION

The present invention relates to portable battery powered printers usable with a computer or other image source.

BACKGROUND OF THE INVENTION

It is known in the prior art to generate images using modulated ejection of ink to print on dye receiving sheets. Electronic images are received by these printers, and images are converted into signals to the ink jet head to selectively transfer dye to the dye receiver sheet to create prints of the received images. Such ink jet printers use low amounts of energy to create prints, opening the possibility of creating portable printers such as the Canon BJC-80 ink jet printer. The BJC-80 uses a small battery to provide power for generating 8.5 by 11 inch images. Because the printer makes a large number of large prints, the printer is large, heavy and cannot be carried on a person. Other printers are not battery powered, have a similar size and require a wall socket to power the computer.

Such printers can be portable and used in field environments to create hard copy prints from apparatus creating and storing digital images. One type of apparatus could be an electronic still camera. Interconnection between the printer can be made through an industry standard infra-red data link (IrDa). Data representing the image is reduced to a binary data stream that is transferred to the printer as light pulses. Alternatively, interconnection can be a two wire data link to transfer the binary formatted image data from an image storage device to the printer.

SUMMARY OF THE INVENTION

It is therefore an object of the present invention to provide a portable battery powered printer which can be used with a standard computer and produce high quality prints.

This object is achieved in a portable battery powered printer for printing images from an image source, the image source having means for storing a digital image and defining an opening comprising:

(a) the printer being sized so as to be insertable into the image source opening and having a rechargeable battery;

(b) means for electrically connecting the printer to the image source after insertion of the printer into the image source opening including;

(i) means for recharging the rechargeable battery; and (ii) means for receiving image data from the image source; and (c) the printer including means for printing an image from the received image data.

It is an advantage of the present invention to provide a portable battery powered printer having an internal power supply that can create prints from digital images in a field setting. The portable battery powered printer design produces a small, light portable battery powered printer that can be carried on a person. A further advantage is that the portable battery powered printer can be inserted into a standard computer to recharge and to print images stored within the computer. The opening in the computer that receives the portable battery powered printer can also receive an electronic camera for recharging and data transmission.

DETAILED DESCRIPTION OF THE INVENTION

Figure 1:
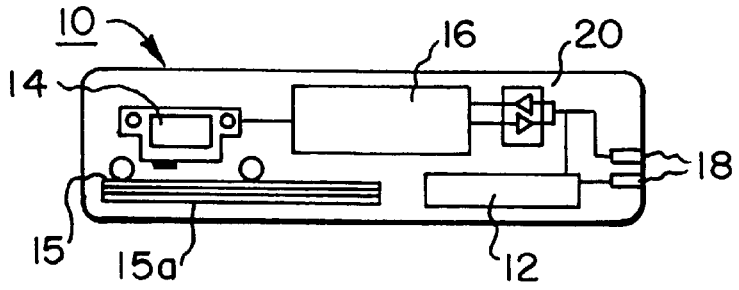
FIG. 1 is a side sectional of a portable battery powered printer which is adapted to be inserted into a bay in a computer in accordance with the present invention.

Turning now to FIG. 1, a portable battery powered printer 10 is shown that according to the present invention. Portable battery powered printer 10 has a power supply 12 storing enough energy to print multiple prints. Power supply 12 can be two rechargeable lithium batteries, each battery being 16.6 mm in diameter and 33 mm long. Power supply 12 provides power to printer electronics 16. Printer electronics 16 can also receive image data from other devices such as electronic still cameras. Printer electronics 16 controls the drive of write head 14 to write image data onto the top ink receiver sheet 15 of a stack of ink receiver sheets 15*a*. In the preferred embodiment, write head 14 is a cartridge having a supply of ink sufficient to write to all ink receiver sheets 15 in the stack of ink receiver sheets 15*a*.

In an alternative embodiment, each ink receiver sheet 15 is a light sensitive media and write head 14 is a light source that is modulated to create an image. In lieu of an ink receiver sheet a sheet 15 can be a Polaroid instant print film and write head 14 can be a small array of red, green and blue light emitting diodes. Sheet 15 can be written and processed by a set of rollers (not shown) as sheet 15 ejects portable battery powered printer 10.

Each ink receiver sheet 15 in ink receiver stack 15*a* in portable battery powered printer 10 are can be smaller than letter size or A4 sheets of paper used in current ink-jet printers. Ink receiver 15 is a sheet of photographic quality coated paper 89 mm wide and 135 mm long. An unprinted 5 mm no-printed border surrounds an image area. The smaller sized prints permits a significant reduction in the width of the portable battery powered printer. The smaller image size reduces the power required to print a set of images. The reduction in power demand reduces the size of the batteries and the size of the portable battery powered printer 10.

Portable battery powered printer 10 further incorporates printer connectors 18*a* and 18*b* that permit recharging of power supply 12. Printer connectors 18*a* and 18*b* can be recessed metallic sockets that receive power from a battery recharging unit. The portable battery powered printer 10 further includes printer transceiver 20 which is electrically connected to printer connectors 18*a* and 18*b*. Printer transceiver 20 can be a high impedance sensor and modulator using printer connectors 18*a* and 18*b* to transmit and receive data from a connector mating to printer connectors 18*a* and 18*b*. Alternatively, printer transceiver 20 can be a separate connector or a non-contact transceiver communicating with devices external to portable battery powered printer 10. Printer transceiver 20 is used to receive image data from the external devices and to communicate the status of portable battery powered printer 10 to outside devices.

Write head 14 can be a Canon BC-11 Color BubbleJet Cartridge. Ink receiver sheet 15 can be coated glossy paper that receives ink from write head 14. The BC-11 ink jet cartridge has the advantage of being sized so that it is less than 27 mm high and uses low power to print. Such print heads facilitate the use of portable battery powered printer 10. The combination of design factors permits portable battery powered printer 10 to be less than 50 mm high, less than 150 mm wide and less than 150 mm deep.

Figure 2:
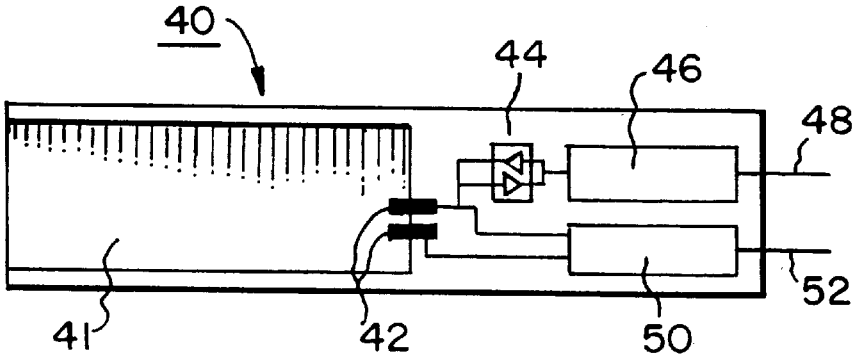
FIG. 2 is a side sectional view of a bay within the computer that receives the printing unit of FIG. 1.

FIG. 2 is a side view of printer receiving sleeve 40 which is capable of holding portable battery powered printer 10. The term "bay" will be understood to those skilled in the art to mean an opening defined by a computer 30 (See FIG. 3) which in this case is sized to receive the portable battery powered printer 10. The computer 30 provides an image source for the portable battery powered printer 10. Portable battery powered printer 10 is designed to be inserted snugly into printer holding area 41. When portable battery powered printer 10 is fully inserted into printer holding area 41, bay connectors 42*a* and 42*b* form electrical interconnection with printer connectors 18*a* and 18*b*. Printer charger 50 operates through the interconnection between portable battery powered printer 10 and printer receiving sleeve 40 to recharge power supply 12 in portable battery powered printer 10. Bay transceiver 44 can operate through the electrical interconnection formed between printer connectors 18*a* and 18*b* and bay connectors 42*a* and 42*b* to send image data to and receive printer status data from portable battery powered printer 10. The interconnection between printer receiving sleeve 40 and portable battery powered printer 10 can be done separate from a power interconnection. Matching electrical sockets or infrared communication ports of standard design can be used to form communication link separate from the power link formed by printer connectors 18*a* and 18*b* and bay connectors 42*a* and 42*b*. Printer receiving sleeve 40 has a computer interface 46 that provides translation of image data received through bay transceiver 44 into a format compatible data communication with portable battery powered printer 10. Data interconnect 48 provides data interconnection between portable battery powered printer 10 through printer receiving sleeve 40 and to computer 30. Data interconnect 40 can be a cable with a card that plugs into a standard computer bus. Alternatively, data interconnect 48 can be a SCSI cable attachable to a chain of other devices using a common SCSI bus. Power interconnect 52 on printer receiving sleeve 40 receives power from computer 30 that is used by printer charger 50 to recharge power supply 12 in portable battery powered printer 10. Power interconnect 52 can be a connector on a multi-drop cable within computer 30 for powering mass storage devices.

Figure 3:
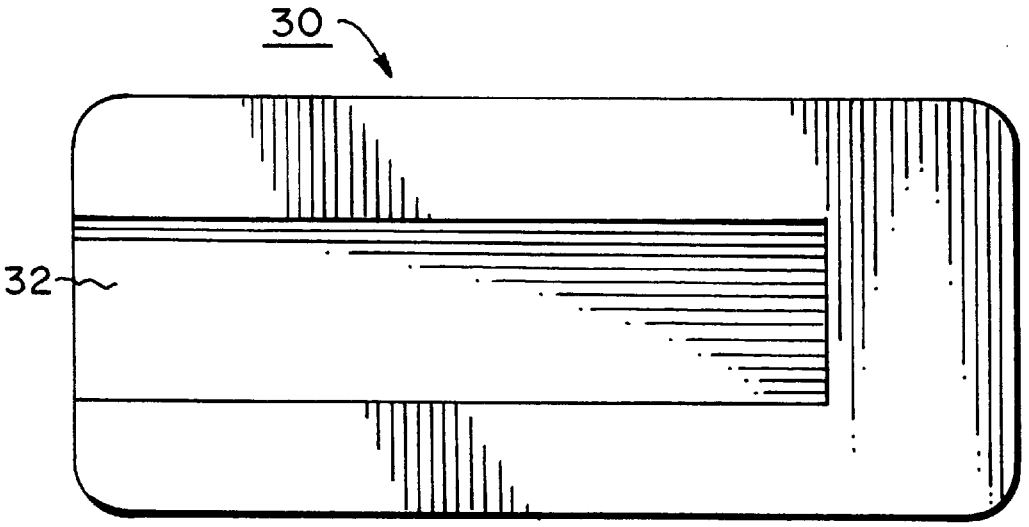
FIG. 3 is a side view of a computer that supports the bay of FIG. 2 in accordance with the present invention.

In FIG. 3 the computer 30, which can be a personal computer of conventional design, is shown which has computer bay 32 having dimensions of larger than portable battery powered printer 10. Typically such bays in personal computers are 50 mm high, 150 mm wide and over 150 mm deep.

Figure 4A:
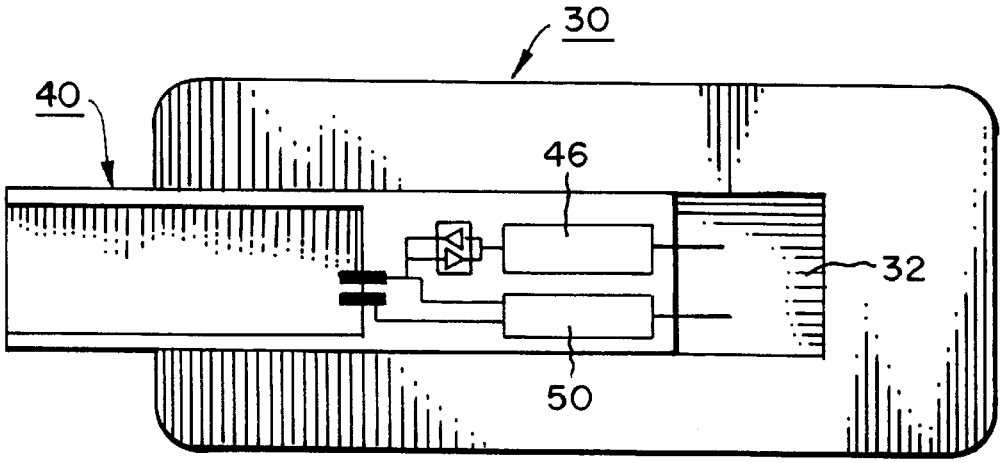
FIG. 4*a* shows the bay of FIG. 2 being installed in the computer of FIG. 3.
Figure 4B:
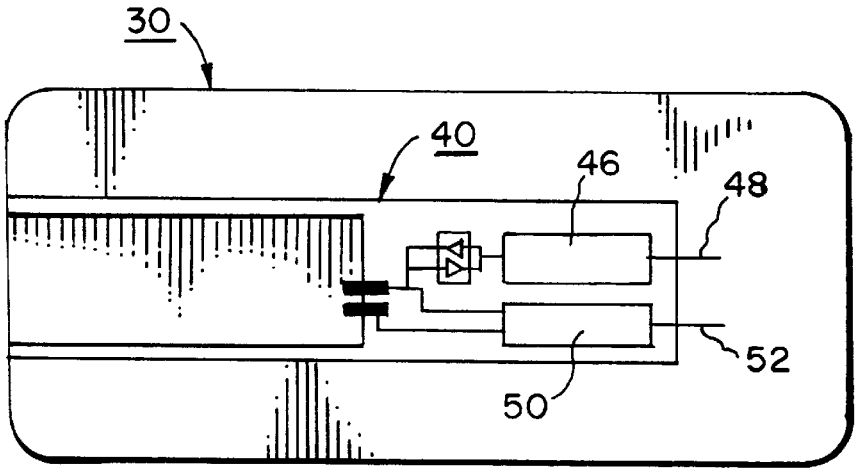
FIG. 4*b* shows the bay of FIG. 2 installed in the computer of FIG. 3.

FIG. 4*a* shows a printer receiver sleeve 40 which has been inserted into the computer bay 32 in computer 30. FIG. 4*b* is a sectional view of printer receiving sleeve 40 installed in computer 30. Data interconnect 48 is plugged into the data bus of computer 30. Power interconnect 52 is connected into the power supply in computer 30.

Figure 5A:
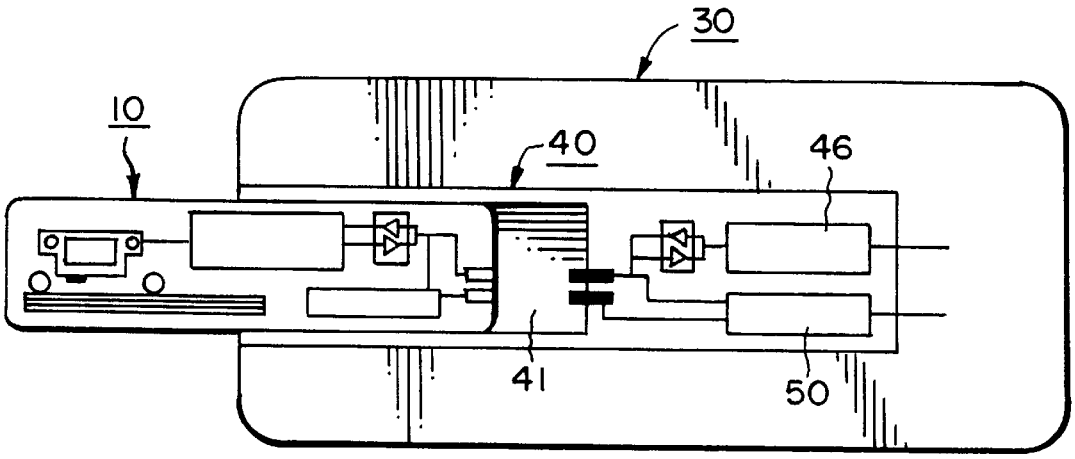
FIG. 5*a* shows the portable battery powered printer of FIG. 1 being installed in the bay of FIG. 2.
Figure 5B:
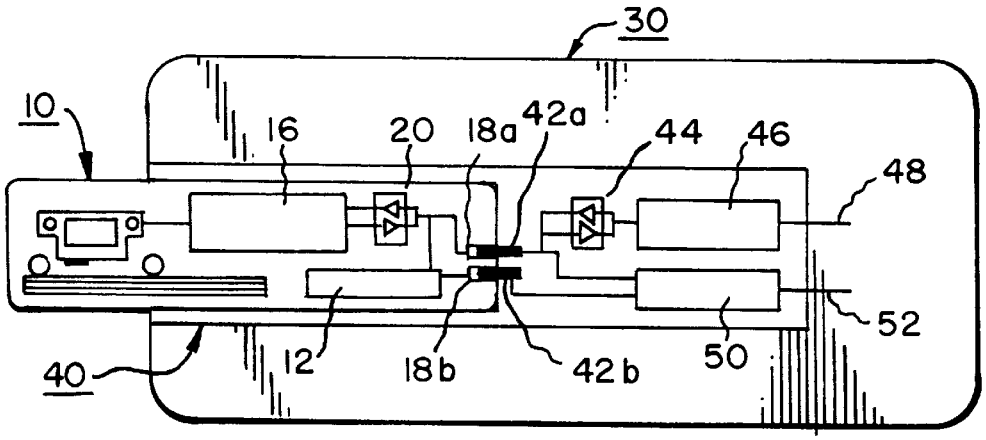
FIG. 5*b* shows the portable battery powered printer of FIG. 1 installed in the bay of FIG. 2.

FIG. 5*a* is a sectional view of portable battery powered printer 10 being inserted into printer receiving sleeve 40 after printer receiving sleeve 40 has been installed in computer 30. FIG. 5*b*. is a sectional view of portable battery powered printer 10 fully inserted into printer receiving sleeve 40. After insertion, portable battery powered printer 10 is securely stored within computer 10. Printer connectors 18*a* and 18*b* have interconnected with bay connectors 42*a* and 42*b*. The interconnection permits power supply 12 in portable battery powered printer 10 to be recharged. Power from computer 30 flows through power interconnect 52 to printer receiving sleeve 40. Within printer receiving sleeve 40, power from computer 30 is operated on by printer charger 50 to recharge or maintain charge on power supply 12 in portable battery powered printer 10.

The interconnection can also be used to transmit image data to and status data from portable battery powered printer 10. Data interconnect 48 passes data to portable battery powered printer 10 through computer interface 46. Data is transferred between computer 30 and portable battery powered printer using bay transceiver 44 and printer transceiver 20. The interconnection formed by printer connectors 18*a* and 18*b* and the bay connectors 42*a* and 42*b* can be used to transcieve data. Alternatively, separate connectors of conventional design can be used for data transmission and reception when portable battery powered printer 10 is inserted into printer receiving sleeve 40. Portable battery powered printer 10 is designed to fit into printer receiving sleeve 40 and interconnect with bay connectors 42*a* and 42*b*. Additionally, portable battery powered printer 10 is designed so that printer transceiver 20 operates with bay transceiver 44 to permit computer 30 to use portable battery powered printer 10 to print images from image data within computer 30.

The invention provides means to store, recharge and communicate with portable battery powered printer 10. The portable battery powered printer acts as a stand alone device when away from printer receiving sleeve 40, and acts as portable battery powered printer built into computer 30 when installed in printer receiving sleeve 40. Printer receiving sleeve 40 can be an integral part of portable battery powered printer 10, providing a storage, recharging and interconnection to removable portable battery powered printer 10.

Figure 6:
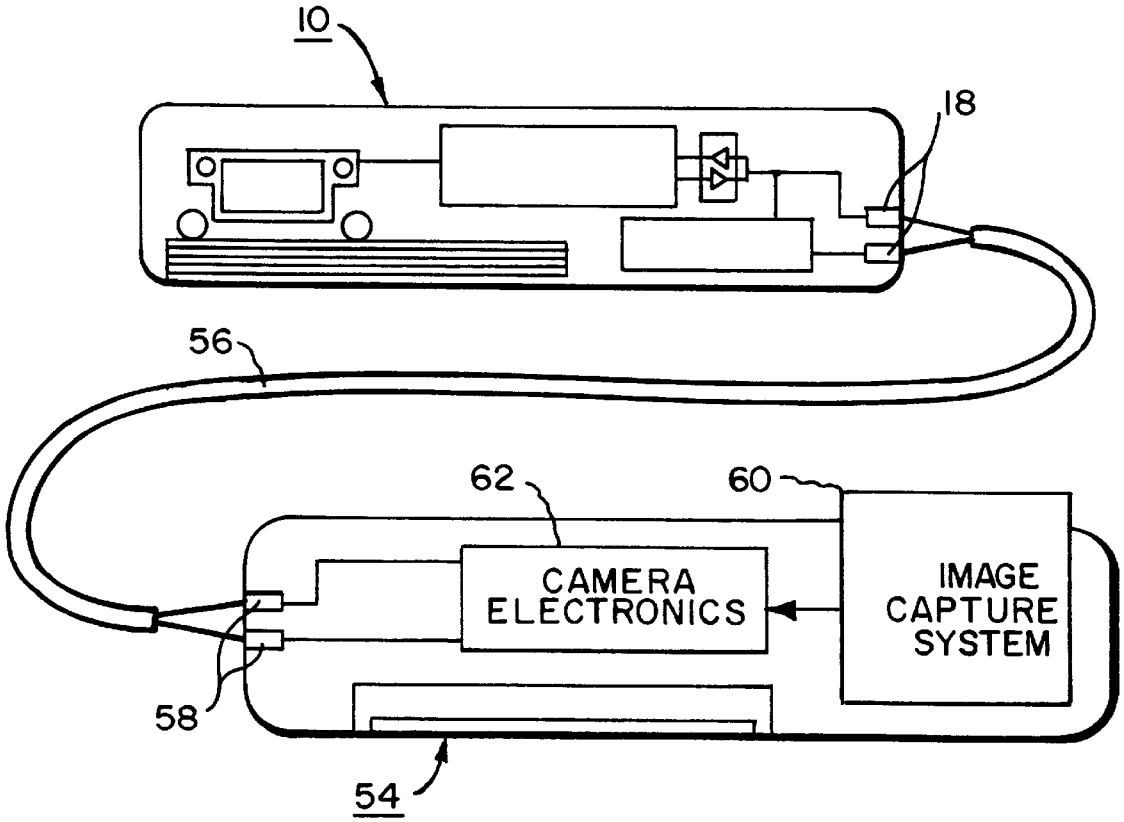
FIG. 6 is a sectional view showing the portable battery powered printer connected to an electronic camera.

FIG. 6 is a sectional view showing the portable battery powered printer 10 connected to an electronic camera 54. In accordance with the present invention the portable battery powered printer 10 can selectively be coupled either to the computer 30 or as shown to the electronic camera 54. Images are delivered to the portable battery powered printer 10 from the electronic camera 54 through camera-printer cable 56. The electronic camera 54 can, of course, be quite conventional and includes an image capture system 60 which will be under-stood to include an image sensor, necessary optics and circuitry for converting a scene captured by the image sensor into a digital image. The digital image is stored in camera electronics 62 which also includes circuitry for delivering the image data from the camera electronics 62 through camera interconnects 58 through camera-printer cable 56 into printer connectors 18 of the portable battery powered printer 10.

The invention has been described in detail with particular reference to a certain preferred embodiment thereof, but it will be understood that variations and modifications can be effected within the spirit and scope of the invention.

PARTS LIST

10 portable battery powered printer
12 power supply
14 write head
15 ink receiver sheet
15*a* ink receiver sheet stack
16 printer electronics
18*a*, 18*b* printer connectors
20 printer transceiver
30 computer
32 computer bay
40 printer receiving sleeve
41 printer holding area
42*a*, 42*b* bay connectors
44 bay transceiver
46 computer interface
48 data interconnect
50 printer charger
52 power interconnect
54 electronic camera
56 camera-printer cable
58 camera interconnect
60 image capture system
62 camera electronics

What is claimed is:

1. A portable battery powered printer for printing images from an image source, the image source having means for storing a digital image and providing an opening comprising:

(a) the portable battery powered printer being insertable into the image source opening and having a rechargeable battery, a print head, and a stack of receiver sheets, the top sheet of which is disposed in printing relationship with the print head;

(b) means for electrically connecting the portable battery powered printer to the image source via the image source opening upon insertion of the portable battery powered printer into the image source opening including;

(i) means for recharging the rechargeable battery through the opening; and (ii) means for receiving image data from the image source; and (c) the portable battery powered printer including means for operating the print head to print an image on the top sheet of the stack of receiver sheets in response to the received image data.

2. A portable battery powered printer for printing images from a computer, the computer having means for storing a digital image and providing an opening comprising:

(a) the portable battery powered printer being insertable into the image source opening and having a rechargeable battery, a print head, and a stack of receiver sheets, the top sheet of which is disposed in printing relationship with the print head;

(b) means for electrically connecting the portable battery powered printer to the computer after insertion of the portable battery powered printer into the computer opening including;

(i) means for recharging the rechargeable battery;

(ii) means for receiving image data from the computer; and (iii) means for transmitting portable battery powered printer status data to the computer; and (c) the portable battery powered printer including means for operating the print head to print an image on the top sheet of the stack of receiver sheets in response to the received image data.

3. The portable battery powered printer of claim 2, wherein the recharging means includes an electrical connector and the receiving image means includes the same electrical connector.

* * * * *